US009874385B2

(12) United States Patent
Izadi-Zamanabadi et al.

(10) Patent No.: US 9,874,385 B2
(45) Date of Patent: Jan. 23, 2018

(54) CONTROL ARRANGEMENT FOR CONTROLLING SUPERHEAT

(71) Applicant: Danfoss A/S, Nordborg (DK)

(72) Inventors: Roozbeh Izadi-Zamanabadi, Soenderborg (DK); Frede Schmidt, Soenderborg (DK)

(73) Assignee: Danfoss A/S, Nordborg (DK)

( * ) Notice: Subject to any disclaimer, the term of this patent is extended or adjusted under 35 U.S.C. 154(b) by 199 days.

(21) Appl. No.: 14/436,684

(22) PCT Filed: Sep. 11, 2013

(86) PCT No.: PCT/DK2013/050291

§ 371 (c)(1),
(2) Date: Apr. 17, 2015

(87) PCT Pub. No.: WO2014/063707

PCT Pub. Date: May 1, 2014

(65) Prior Publication Data

US 2015/0323234 A1 Nov. 12, 2015

(30) Foreign Application Priority Data

Oct. 23, 2012 (DK) ..... 2012 00649

(51) Int. Cl.
*F25B 49/02* (2006.01)
*F25B 41/06* (2006.01)

(52) U.S. Cl.
CPC ..... *F25B 49/02* (2013.01); *F25B 41/062* (2013.01); *F25B 2341/0683* (2013.01);
(Continued)

(58) Field of Classification Search
CPC ..... F25B 41/062; F25B 2341/0683; F25B 2600/21; F25B 2600/2513; Y02B 30/72
See application file for complete search history.

(56) References Cited

U.S. PATENT DOCUMENTS 4,187,543 A * 2/1980 Healey ..... F24F 11/06 165/208
4,848,099 A * 7/1989 Beckey ..... F25B 41/062 236/78 D (Continued)

FOREIGN PATENT DOCUMENTS

CN 102384618 A 3/2012
EP 1965158 A2 9/2008

(Continued)

OTHER PUBLICATIONS

"Chapter 8: Band-pass Filters." All About Circuits. Http://www.allaboutcircuits.com/textbook/alternating-current/chpt-8/band-pass-filters/, Feb. 1, 2001. Web. Dec. 20, 2016.*

(Continued)

*Primary Examiner* — Jonathan Bradford
(74) *Attorney, Agent, or Firm* — McCormick, Paulding & Huber LLP

(57) ABSTRACT

A control arrangement for controlling a superheat of a vapour compression system includes a first sensor and a second sensor for measuring control parameters allowing a superheat value to be derived, a first controller arranged to receive a signal from the first sensor, a second controller arranged to receive a superheat value derived by a subtraction element, and to supply a control signal, based on the derived superheat value and a reference superheat value, and a summation element arranged to receive input from the the controllers, the summation element being arranged to supply a control signal for controlling opening degree of the expansion device. According to a first aspect the control arrangement includes a low pass filter arranged to receive a signal from the first sensor and to supply a signal to the subtraction element. According to a second aspect the first controller includes a PD element.

20 Claims, 3 Drawing Sheets

(52) U.S. Cl.
CPC ... *F25B 2600/21* (2013.01); *F25B 2600/2513* (2013.01); *F25B 2700/197* (2013.01); *F25B 2700/21172* (2013.01); *F25B 2700/21173* (2013.01); *F25B 2700/21175* (2013.01)

(56) References Cited

U.S. PATENT DOCUMENTS

| | | | | |
|---|---|---|---|---|
| 5,782,103 | A * | 7/1998 | Schmidt | F25B 41/062 62/225 |
| 5,936,919 | A * | 8/1999 | Bates | G11B 7/08541 369/44.29 |
| 2011/0005250 | A1 | 1/2011 | Perz | |

FOREIGN PATENT DOCUMENTS

| | | | |
|---|---|---|---|
| WO | 2009039850 | A1 | 4/2009 |
| WO | 2012052019 | A1 | 4/2012 |

OTHER PUBLICATIONS

Lee, Yun, Kiam Heong Ang, and Gregory C.Y. Chong. "PID Control System Analysis and Design." (n.d.): n. pag. University of Glasgow. Nov. 13, 2007. Web. Jul. 5, 2017. <http://eprints.gla.ac.uk/3815/1/IEEE_CS_PID_01580152.pdf>.*

International Search Report for PCT Serial No. PCT/DK2013/050291 dated Dec. 13, 2013.

* cited by examiner

CONTROL ARRANGEMENT FOR CONTROLLING SUPERHEAT

CROSS-REFERENCE TO RELATED APPLICATION

This application is entitled to the benefit of and incorporates by reference subject matter disclosed in the International Patent Application No. PCT/DK2013/050291 filed on Sep. 11, 2013 and Danish Patent Application PA 2012 00649 filed Oct. 23, 2012.

FIELD OF THE INVENTION

The present invention relates to a control arrangement for controlling superheat of a vapour compression system, such as a refrigeration system, an air condition system or a heat pump. The control arrangement of the invention can be used in combination with any control algorithm which is suitable for the specific application, and is not limited to a specific control algorithm.

BACKGROUND

When controlling a vapour compression system, such as a refrigeration system, an air condition system or a heat pump, the supply of refrigerant to an evaporator is normally controlled in such a manner that the superheat value of refrigerant leaving the evaporator is maintained at a small, positive value. The superheat value is the temperature difference between the temperature of refrigerant leaving the evaporator and the dew point of refrigerant leaving the evaporator. Thus, a high superheat value indicates that gaseous and heated refrigerant is leaving the evaporator, and therefore the refrigeration capacity of the evaporator is not utilised optimally, and the vapour compression system is not operated in an efficient manner. On the other hand, zero superheat value indicates that the refrigerant leaving the evaporator is at the dew point. Thereby there is a risk that liquid refrigerant is leaving the evaporator. If liquid refrigerant reaches the compressor, the compressor may suffer damage, and it is therefore desirable to avoid that liquid refrigerant leaves the evaporator. Thus, a small, but positive, superheat value ensures that the vapour compression system is operated in an energy efficient manner, without risking damage to the compressor.

The supply of refrigerant to the evaporator may be controlled by controlling an opening degree of an expansion device, e.g. in the form of an expansion valve. The control signal for the expansion device may be supplied by a control arrangement, which derives the control signal on the basis of the superheat value which has been derived from suitable measured parameters.

U.S. Pat. No. 5,782,103 discloses an example of such a control arrangement. The control arrangement contains a measuring device connected to the evaporator, which device produces a measurement signal that is a measure of the superheat temperature of the refrigerant in the evaporator. The control arrangement further comprises a comparator to which the measurement signal and a desired superheat signal are arranged to be supplied. A PID controller is arranged between the comparator and the expansion valve. For rapid compensation of changes in the superheat temperature, a control signal proportional to the evaporating temperature of the refrigerant is arranged to be supplied additionally to the PID controller.

The control arrangement of U.S. Pat. No. 5,782,103 can only be used in combination with a PID control algorithm. This is a disadvantage, because in some applications another control algorithm would be more suitable.

SUMMARY

It is, thus, an object of embodiments of the invention to provide a control arrangement for controlling a superheat of a vapour compression system, where the control arrangement can be used in combination with any control algorithm.

According to a first aspect the invention provides a control arrangement for controlling a superheat of a vapour compression system, the vapour compression system comprising a compressor, a condenser, an expansion device and an evaporator arranged along a refrigerant path, the control arrangement comprising:

- a first sensor arranged to measure a first control parameter of refrigerant flowing in the refrigerant path,
- a second sensor arranged to measure a second control parameter of refrigerant flowing in the refrigerant path, wherein the superheat value of the vapour compression system can be derived by means of the first control parameter and the second control parameter,
- a low pass filter arranged to receive a signal from the first sensor, said low pass filter being designed in accordance with dynamic behaviour of the evaporator and/or of the first sensor,
- a first controller arranged to receive a signal from the first sensor,
- a subtraction element arranged to receive input from the second sensor and from the low pass filter, said subtraction element being arranged to derive a superheat value, based on the received input,
- a second controller arranged to receive the superheat value derived by the subtraction element, and to supply a control signal, based on the derived superheat value, and in accordance with a reference superheat value,
- a summation element arranged to receive input from the first controller and from the second controller, said summation element being arranged to supply a control signal for controlling opening degree of the expansion device on the basis of the received input.

The invention according to the first aspect provides a control arrangement for controlling a superheat of a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc. The vapour compression system, thus, comprises a compressor, a condenser, an expansion device, e.g. in the form of an expansion valve, and an evaporator, arranged along a refrigerant path.

As described above, the superheat of refrigerant leaving the evaporator of a vapour compression system is the temperature difference between the temperature of refrigerant leaving the evaporator and the dew point of refrigerant leaving the evaporator. Accordingly, the control arrangement of the present invention is adapted to control this temperature difference, preferably in such a manner that the superheat is small, but positive, as described above. This is normally done by controlling the supply of refrigerant to the evaporator, e.g. by controlling an opening degree of the expansion device.

The compressor may be in the form of a single compressor, e.g. a fixed speed compressor, a two stage compressor or a variable speed compressor. Alternatively, the compressor may be in the form of a compressor rack comprising two or more individual compressors. Each of the compressors in the compressor rack could be a fixed speed compressor, a two stage compressor or a variable speed compressor.

The expansion device may, e.g., be in the form of an expansion valve, such as a thermostatic expansion valve, and/or an electronically controlled expansion valve. As an alternative, the expansion device may be in the form of an orifice or a capillary tube.

The evaporator may be in the form of a single evaporator comprising a single evaporator coil or two or more evaporator coils arranged in parallel. As an alternative, the evaporator may comprise two or more evaporators arranged in parallel in the refrigerant path.

The control arrangement comprises a first sensor and a second sensor. The first sensor is arranged to measure a first control parameter of refrigerant flowing in the refrigerant path, and the second sensor is arranged to measure a second control parameter of refrigerant flowing in the refrigerant path. The first control parameter and the second control parameter are selected in such a manner that the superheat of the vapour compression system can be derived by means of the first control parameter and the second control parameter. For instance, one of the control parameters may be indicative for the temperature of refrigerant leaving the evaporator, while the other control parameter may be indicative for the dew point of refrigerant leaving the evaporator, or of the evaporation temperature. In this case the superheat can simply be derived as the difference between the two measured control parameters. This will be described in further detail below.

The control arrangement further comprises a low pass filter arranged to receive a signal from the first sensor. Thereby high frequency variations in the signal from the first sensor are attenuated before the signal is passed on by the low pass filter. The low pass filter is designed in accordance with dynamic behaviour of the evaporator and/or of the first sensor. In the present context the term 'dynamic behaviour of the evaporator or sensor' should be interpreted to mean the behaviour of the evaporator or sensor in terms of variations of various parameters, such as temperature and/or pressure of refrigerant flowing through the evaporator, as a function of time. Thus the dynamic behaviour of the evaporator and/or sensor includes information regarding the timescales on which temperature and/or pressure of refrigerant passing through the evaporator vary during operation of the vapour compression system. If such information is not initially available, it can easily be obtained by monitoring the relevant parameters for a period of time.

The low pass filter may form part of a filter block. In this case the filter block may contain further components.

Since the low pass filter is designed in accordance with the dynamic behaviour of the evaporator and/or of the first sensor, it is designed in such a manner that only the relevant part of the signal from the first sensor is passed on by the low pass filter, and the part which is of no interest is filtered out. Due to the low pass filter, the control arrangement according to the first aspect of the invention is very suitable for use in a vapour compression system, where the first sensor is a pressure sensor measuring the pressure of refrigerant leaving the evaporator.

A subtraction element is arranged to receive input from the second sensor and from the low pass filter. Thus, the subtraction element receives the 'relevant' part of the signal from the first sensor, as defined above, and the 'raw' signal from the second sensor. In the case that the first sensor provides a signal which is indicative for the dew point of the refrigerant leaving the evaporator, or of the evaporation temperature, and the second sensor provides a signal which is indicative for the temperature of refrigerant leaving the evaporator, the superheat value may be obtained by subtracting the signal received from the low pass filter from the signal received from the second sensor. Accordingly, the subtraction element is arranged to derive a superheat value, based on the received input.

In the present context, the term 'subtraction element' should be interpreted to mean an element which is capable of receiving two input signals and supplying one output signal, the output signal being the difference between the two input signals. The subtraction element may, e.g., be in the form of an electronic component. As an alternative, the subtraction element may be or comprise a software component arranged to perform the required processing on the received input signals.

A second controller is arranged to receive the superheat value derived by the subtraction element. The second controller supplies a control signal, based on the derived superheat value, and in accordance with a reference superheat value. The reference superheat value may advantageously be an optimal superheat value. In this case the control arrangement seeks to control the supply of refrigerant to the evaporator in order to obtain an actual superheat value of refrigerant leaving the evaporator, which is equal to the reference superheat value. Thus, the second controller may generate the control signal on the basis of a comparison between the derived superheat value and the reference superheat value.

A summation element is arranged to receive input from a first controller and from the second controller. The first controller is arranged to receive a signal from the first sensor. Thus, the signal supplied to the summation element from the first controller reflects the measurements performed by the first sensor. The first controller may be arranged to perform some kind of signal processing on the signal received from the first sensor. As an alternative, the first controller may simply pass the measured signal on, possibly with a suitable gain. This will be described in further detail below.

Accordingly, the summation element receives an input from the first controller which reflects the measurements performed by the first sensor. Furthermore, the summation element receives an input from the second controller which reflects the current superheat value, as compared to the reference superheat value. Based on these two inputs, the summation element generates a control signal which is supplied to the expansion device, or to a control unit controlling the expansion device. Based on the control signal supplied by the summation element, the opening degree of the expansion device is adjusted, in order to obtain a superheat value which is equal to the reference superheat value. For instance, the two inputs may be in the form of real numbers which are simply added in the summation element to obtain a third real number. The third real number may then be transformed into a physical variable, such as a current or a voltage, which can be used for adjusting the opening degree of the expansion device.

In the present context the term 'summation element' should be interpreted to mean an element which is capable of receiving two input signals and supplying one output signal, the output signal being the sum of the two input signals. The summation element may, e.g., be in the form of an electronic component. As an alternative, the summation element may be or comprise a software component arranged to perform the required processing on the received input signals.

The first controller may comprise a proportional differential (PD) element. According to this embodiment, the signal from the first sensor is passed through a PD element before it is supplied to the summation element. Thereby the differential part of the signal processing is contained in the first controller, and therefore only affects the signal obtained by the first sensor. Thus, the differential element does not affect the signal which passes through the second controller. This makes the control arrangement very suitable for use in vapour compression systems where the first sensor is a temperature sensor measuring the temperature of refrigerant entering the evaporator.

The first controller may comprise a high pass filter, e.g. as a part of a PD element. According to this embodiment, the first controller allows high frequency variations of the measurements performed by the first sensor to pass through the first controller. Accordingly, such variations are supplied to the summation element. Thereby it is possible to select, as the first sensor, a sensor which reacts quickly to changes in the evaporation temperature. For instance, the first sensor may be a temperature sensor measuring the temperature of refrigerant entering the evaporator, or a pressure sensor measuring the pressure of refrigerant leaving the evaporator, since the evaporation temperature of the refrigerant passing through the evaporator can be derived from any of these parameters. Changes in the superheat value of the refrigerant leaving the evaporator, thus, result in changes in the temperature of refrigerant entering the evaporator, as well as in changes in the pressure of refrigerant leaving the evaporator. However, a pressure sensor typically has much faster dynamics than a temperature sensor, and will therefore react faster to changes in the evaporation temperature. Thus, when the first controller comprises a high pass filter, the first sensor may advantageously be a temperature sensor.

The high pass filter may be designed in accordance with the dynamic behaviour of the first sensor. Thereby it is ensured that only the relevant part of the measured signal is passed through the first controller.

The high pass filter may be arranged in parallel to an additional signal path. The additional signal path allows the frequency range, which is dependent on the dynamic characteristics of the chosen first sensor, to pass. Thereby the type of the first sensor is not limited by the first controller, and temperature sensor or a pressure sensor may be applied, depending on the specific application, without altering the first controller. For instance, if a pressure sensor is used, the 'P' part of the first controller is essentially used, and when a temperature sensor is used the whole 'PD' structure of the first controller is used, the 'D' part of the first controller being materialized by means of the high pass filter.

The first controller may further comprise a limiter arranged in the signal path after the high pass filter. The limiter ensures that the part of the signal obtained by the first sensor, which comprises very high frequent variations, is not passed through the first controller. Thereby it is avoided that very large control signals are generated. This is an advantage, because large control signals result in non-smooth operation of the controller. The first controller may further comprise a proportional gain unit. According to this embodiment the signal received from the first sensor is amplified by a factor, K, specified by the proportional gain unit before it is supplied to the summation element. The absolute value of K may, e.g., be chosen in the range [2, . . . , 10].

The first control parameter may be the temperature of refrigerant entering the evaporator. According to this embodiment, the first sensor is a temperature sensor arranged at or near an inlet opening of the evaporator. The temperature sensor may advantageously be arranged in the refrigerant path, thereby being in direct contact with the refrigerant, but it may, alternatively, be arranged on or adjacent to an outer wall of piping leading refrigerant into the evaporator. As described above, the evaporation temperature of the refrigerant passing through the evaporator can be derived from the temperature of refrigerant entering the evaporator. Therefore this parameter is useful for determining the superheat value of refrigerant leaving the evaporator.

As an alternative, the first control parameter may be the pressure of refrigerant leaving the evaporator. According to this embodiment, the first sensor is a pressure sensor arranged in the refrigerant path at or near an outlet opening of the evaporator. As described above, the evaporation temperature of the refrigerant passing through the evaporator can be derived from the pressure of the refrigerant leaving the evaporator. Therefore this parameter is also useful for determining the superheat value of refrigerant leaving the evaporator.

As another alternative, any other suitable control parameter reflecting the evaporation temperature may be chosen.

The second control parameter may be the temperature of refrigerant leaving the evaporator. According to this embodiment, the second sensor is a temperature sensor arranged at or near an outlet opening of the evaporator. The temperature sensor may advantageously be arranged in the refrigerant path, thereby being in direct contact with the refrigerant, but it may, alternatively, be arranged on or adjacent to an outer wall of piping leading refrigerant out of the evaporator.

As described above, the superheat value can be calculated as the temperature difference between the temperature of the refrigerant leaving the evaporator and the evaporation temperature of refrigerant passing through the evaporator. It is therefore an advantage if one of the measured control parameters reflects the evaporation temperature, and the other measured control parameter reflects the temperature of refrigerant leaving the evaporator, since in this case the superheat value can easily be derived on the basis of the measured control parameters. However, other suitable control parameters could also be envisaged, as long as the superheat value can be derived on the basis of the measured control parameters.

According to a second aspect the invention provides a control arrangement for controlling a superheat of a vapour compression system, the vapour compression system comprising a compressor, a condenser, an expansion device and an evaporator arranged along a refrigerant path, the control arrangement comprising:

- a first sensor arranged to measure a first control parameter of refrigerant flowing in the refrigerant path,
- a second sensor arranged to measure a second control parameter of refrigerant flowing in the refrigerant path, wherein the superheat value of the vapour compression system can be derived by means of the first control parameter and the second control parameter,
- a first controller arranged to receive a signal from the first sensor, said first controller comprising a proportional differential (PD) element,
- a subtraction element arranged to receive input from the second sensor and from the first sensor, said subtraction element being arranged to derive a superheat value, based on the received input, a second controller arranged to receive the superheat value derived by the subtraction element, and to supply a control signal, based on the derived superheat value, and in accordance with a reference superheat value, a summation element arranged to receive input from the first controller and from the second controller, said summation element being arranged to supply a control signal for controlling opening degree of the expansion device on the basis of the received input.

It should be noted that a person skilled in the art would readily recognise that any feature described in combination with the first aspect of the invention could also be combined with the second aspect of the invention, and vice versa. Thus, the features which have already been described above with reference to the first aspect of the invention will not be described in detail here.

According to the second aspect of the invention, the first controller comprises a proportional differential (PD) element. As described above with reference to the first aspect of the invention, this makes the control arrangement very suitable for use with a vapour compression system where the first sensor is a temperature sensor measuring the temperature of refrigerant entering the evaporator.

The control arrangement may further comprise a low pass filter arranged to receive a signal from the first sensor and to supply a signal to the subtraction element, said low pass filter being designed in accordance with dynamic behaviour of the evaporator and/or of the first sensor. As described above with reference to the first aspect of the invention, this makes the control arrangement very suitable for use with a vapour compression system where the first sensor is a pressure sensor measuring the pressure of refrigerant leaving the evaporator.

Thus, when the control arrangement comprises a low pass filter as described above, and the first controller comprises a PD element, the control arrangement is suitable when the first sensor is a temperature sensor, as well as when the first sensor is a pressure sensor. Accordingly, a suitable type of sensor can be selected, without having to perform changes to the control arrangement.

Thus, the first control parameter may be the temperature of refrigerant entering the evaporator, or the first control parameter may be the pressure of refrigerant leaving the evaporator, as described above with reference to the first aspect of the invention.

Furthermore, the second control parameter may be the temperature of refrigerant leaving the evaporator. This has also been described above with reference to the first aspect of the invention.

BRIEF DESCRIPTION OF THE DRAWINGS

The invention will now be described in further detail with reference to the accompanying drawings in which.

DETAILED DESCRIPTION

Figure 1:
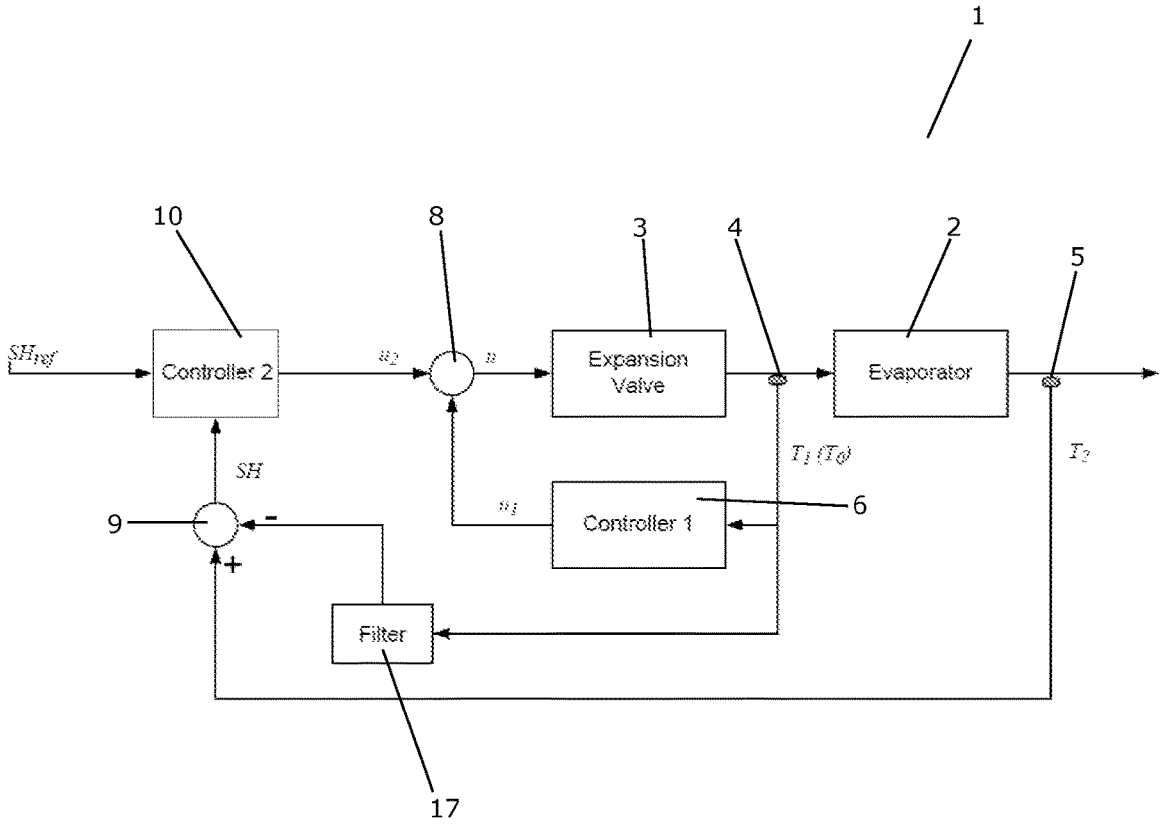
FIG. 1 is a block diagram of a control arrangement according to a first embodiment of the invention.

FIG. 1 is a block diagram of a control arrangement 1 according to a first embodiment of the invention. The control arrangement 1 of FIG. 1 can be used for controlling a supply of refrigerant to an evaporator 2 of a vapour compression system, in order to obtain a desired superheat value of refrigerant leaving the evaporator 3. This is done by controlling an opening degree of an expansion valve 3 arranged to supply refrigerant to the evaporator 2.

The control arrangement 1 comprises a first sensor 4 and a second sensor 5. The first sensor 4 is a temperature sensor arranged in the refrigerant path between the expansion valve 3 and the evaporator 2, at or near an inlet opening of the evaporator 2. Thus, the first sensor 4 measures the temperature of refrigerant entering the evaporator 2. The first sensor 4 could, alternatively, be arranged on an outer wall of piping leading refrigerant to the evaporator 2.

The second sensor 5 is a temperature sensor arranged in the refrigerant path at or near an outlet opening of the evaporator 2. Thus, the second sensor 5 measures the temperature of refrigerant leaving the evaporator 2. The second sensor 5 could, alternatively, be arranged on an outer wall of piping leading refrigerant out of the evaporator 2.

The superheat value of refrigerant leaving the evaporator 2 can be calculated as the temperature difference between the temperature of refrigerant leaving the evaporator 2 and the evaporation temperature of refrigerant passing through the evaporator 2. The evaporation temperature can be derived from the temperature of refrigerant entering the evaporator 2. Accordingly, the superheat value can be derived by means of the measurements performed by the first sensor 4 and the second sensor 5.

As an alternative, the first sensor 4 could be replaced by a pressure sensor arranged in the refrigerant path at or near an outlet opening of the evaporator 2. In this case the first sensor would measure the pressure of refrigerant leaving the evaporator 2. Since the evaporation temperature can also be derived from the pressure of refrigerant leaving the evaporator, the superheat could be derived by means of measurements performed by such a pressure sensor and the second sensor 5 shown in FIG. 1.

The temperature signal obtained by the first sensor 4 is supplied to a first controller 6 and to a filter block 17 comprising a low pass filter. In the first controller 6, the temperature signal is processed, and a processed output signal, $u_1$, is supplied to a summation element 8. The summation element 8 will be described in further detail below. The processing taking place in the first controller 6 could be any suitable kind of processing, including simple amplification of the signal by a proportional gain factor, and/or the first controller 6 may comprise a proportional differential (PD) element. Another alternative will be described below with reference to FIG. 2.

In the filter block 17 high frequency variations in the measured temperature signal are filtered out, and only the part of the signal which varies at low frequencies is passed on. The low pass filter of the filter block 17 is designed in accordance with dynamic behaviour of the evaporator 2 and/or of the first temperature sensor 4, i.e. in accordance with the behaviour of the evaporator 2 and/or the first temperature sensor 4 in terms of variations of various parameters, such as temperature and/or pressure of refrigerant passing through the evaporator 2, as a function of time. Thus, the low pass filter is designed in such a manner that only the relevant part of the temperature signal from the first sensor 4 is passed on by the filter block 17, and the part which is of no interest is filtered out.

The signal which is output by the filter block 17 is supplied to a subtraction element 9. The temperature signal measured by the second sensor 5 is also supplied directly to the subtraction element 9. Thus, the subtraction element 9 receives a signal indicating the temperature of refrigerant leaving the evaporator 2 and a signal indicating the evaporation temperature. Thus, by subtracting the signal received from the filter block 17 from the signal received from the second sensor 5, the subtraction element 9 is capable of deriving the superheat value of refrigerant leaving the evaporator 2. This derived superheat value is supplied to a second controller 10.

The second controller 10 further receives a reference superheat value. The reference superheat value may be a fixed value which corresponds to a superheat which it is desired to obtain for the refrigerant leaving the evaporator 2. The second controller 10 generates a control signal, $u_2$, on the basis of the derived superheat value, received from the subtraction element 9, and the reference superheat value. The second controller 10 may be any suitable kind of controller, and the control arrangement 1 does not limit the choice of the type of controller. This is due to the fact that the low pass filter of the filter block 17 is designed in accordance with the dynamical behaviour of the evaporator 2 and/or of the first sensor 4, and therefore only allows the part of the signal which is of interest to pass.

The control signal, $u_2$, which is generated by the second controller 10, is supplied to the summation element 8. At summation element 8 a control signal, u, for the expansion valve 3 is generated. The control signal, u, may be generated by adding the received signals, $u_1$ and $u_2$. The signal $u_1$ is generated by the first controller 6, and the signal $u_2$ is generated by the second controller 10.

Based on the control signal, u, an opening degree of the expansion valve 3 is adjusted. Thereby the supply of refrigerant to the evaporator 2 is adjusted, thereby changing the superheat of refrigerant leaving the evaporator. The adjustment of the opening degree of the expansion valve 3 is performed in such a manner that the superheat value approaches the reference superheat value. Thus, if the superheat value is too high, the opening degree of the expansion valve 3 is increased in order to increase the supply of refrigerant to the evaporator 2, and if the superheat value is too low, the opening degree of the expansion valve 3 is decreased in order to decrease the supply of refrigerant to the evaporator 2.

As described above, the first controller 6 may comprise a PD element. In this case, the control arrangement 1 is suitable for use with a vapour compression system in which the first sensor is a temperature sensor, as shown in FIG. 1, as well as with a vapour compression system in which the first sensor is a pressure sensor. When a temperature sensor is selected, a low pass filter is not required in the filter block 17, and it may therefore be designed in such a manner that it allows more or less all frequencies to pass. However, in this case the differential part of the PD element is very important, since the 'D' part of the PD element, which is normally realized by a high pass filter, or a filter with the same dynamic behaviour, ensures, together with the 'P' part, that the original dynamic behaviour of the evaporation temperature is reconstructed and passed to the summation element 8.

On the other hand, when a pressure sensor is selected, the differential part of the PD element is not required, and the differential part may therefore be set to zero. However, in this case the low pass filter in the filter block 17 is very important, since the low pass filter ensures that only the relevant part of the pressure signal is allowed to pass to the subtraction element 9.

Thus, the control arrangement 1 shown in FIG. 1 can be used with a vapour compression system where the first sensor is a temperature sensor, as well as with a vapour compression system where the first sensor is a pressure sensor, without having to perform modifications to the control arrangement 1.

Figure 2:
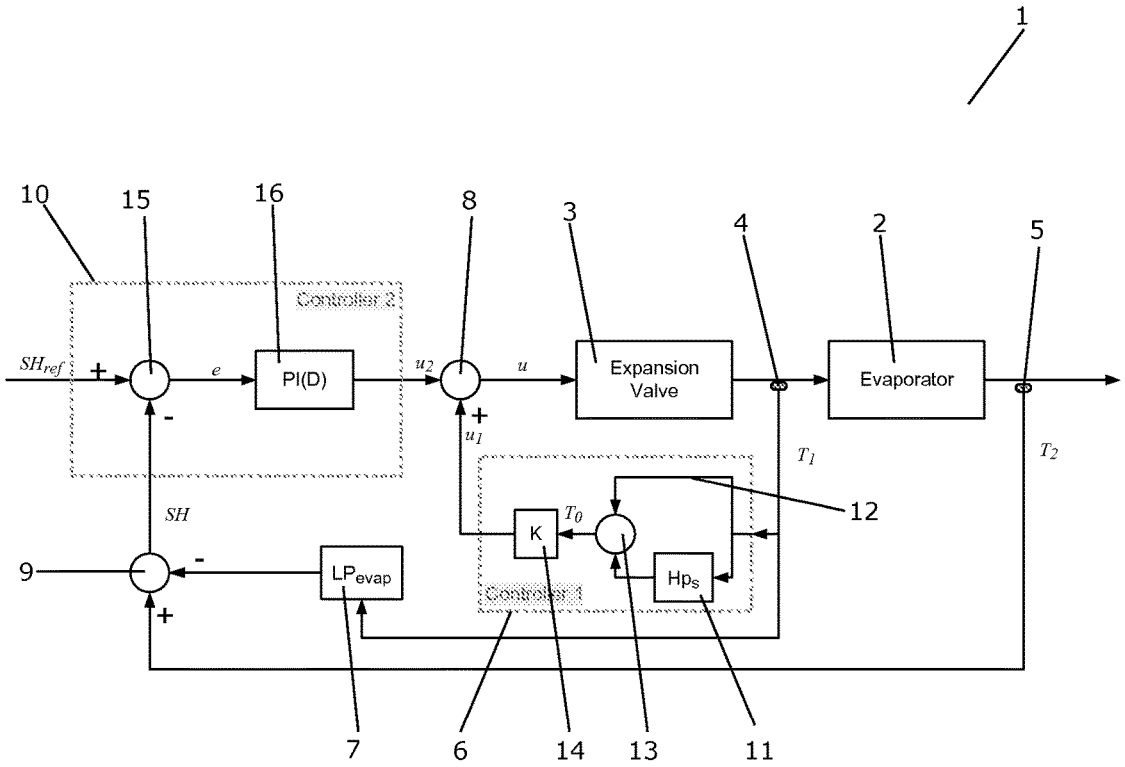
FIG. 2 is a block diagram of a control arrangement according to a second embodiment of the invention.

FIG. 2 is a block diagram of a control arrangement 1 according to a second embodiment of the invention. The control arrangement 1 of FIG. 2 is very similar to the control arrangement 1 of FIG. 1, and it will therefore not be described in further detail here.

In FIG. 2, details of the first controller 6 and of the second controller 10 are shown. Furthermore, the filter block illustrated in FIG. 1 has been replaced by a low pass filter 7. The first controller 6 comprises a high pass filter 11 arranged in parallel with a second signal path 12. Thus, the temperature signal received from the first sensor 4 is partly passed through the high pass filter 11, and partly through the second signal path 12. The two signal parts are added in summation element 13 and supplied to a proportional gain unit 14, where the signal is amplified by a factor K. Thus, the signal supplied by the first controller is $u_1=K(T_1+HP(T_1))$, where $T_1$ represents the evaporation temperature measured by the first sensor 4 and supplied to the first controller 6, $HP(T_1)$ is the signal passed through the high pass filter 11, and K is the gain of the proportional gain unit 14.

The signal path having the high pass filter 11 arranged therein allows high frequency variations of the temperature signal received from the first sensor 4 to pass through the first controller 6, but prevents low frequency variations from passing. Thereby it is ensured that the control arrangement 1 is able to react quickly to changes in the measured signal. Furthermore, the additional signal path 12 allows low frequency signals as well as high frequency signals to pass through the first controller 6. Thereby it is ensured that the control arrangement 1 is also able to react on slower variations in the measured signal. Thus, the control arrangement 1 of FIG. 2 is able to react to slow variations as well as fast variations in the measured signal. Thereby the control arrangement 1 can be used in combination with a sensor type which reacts slowly to variations in the superheat value, as well as a sensor type which reacts quickly to variations in the superheat value. For instance, a pressure sensor reacts faster to variations in the superheat value than a temperature sensor. Accordingly, in the control arrangement 1 of FIG. 2 the first sensor 4 can readily be replaced by a sensor measuring the pressure of refrigerant leaving the evaporator 2 without having to modify the first controller 6.

The high pass filter 11 may be designed in accordance with the dynamic behaviour of the first sensor 4. Thereby it is ensured that only the relevant part of the measured signal is passed through the first controller 6.

The second controller 10 comprises a subtraction element 15 and a proportional-integral-derivative (PI(D)) control unit 16. The superheat value derived by the subtraction element 9 as well as the reference superheat value is supplied to the subtraction element 15 of the second controller 10. Based thereon the subtraction element 15 derives an error signal, e, which is supplied to the PI(D) control unit 16. The error signal, e, reflects the difference between the actual superheat value and the reference superheat value, thereby indicating whether the actual superheat value must be increased or decreased, and how much, in order to reach an actual superheat value which is identical to the reference superheat value.

Based on the received error signal, e, the PI(D) control unit 16 generates a control signal, $u_2$, which is supplied to the summation element 8 and used for generating the control signal, u, for the expansion valve 3.

It should be noted that even though the second controller 10 illustrated in FIG. 2 comprises a subtraction element 15 and a PI(D) control unit 16, any other suitable controller could be applied, and the choice of controller is not limited by the control arrangement 1, as described above.

Figure 3:
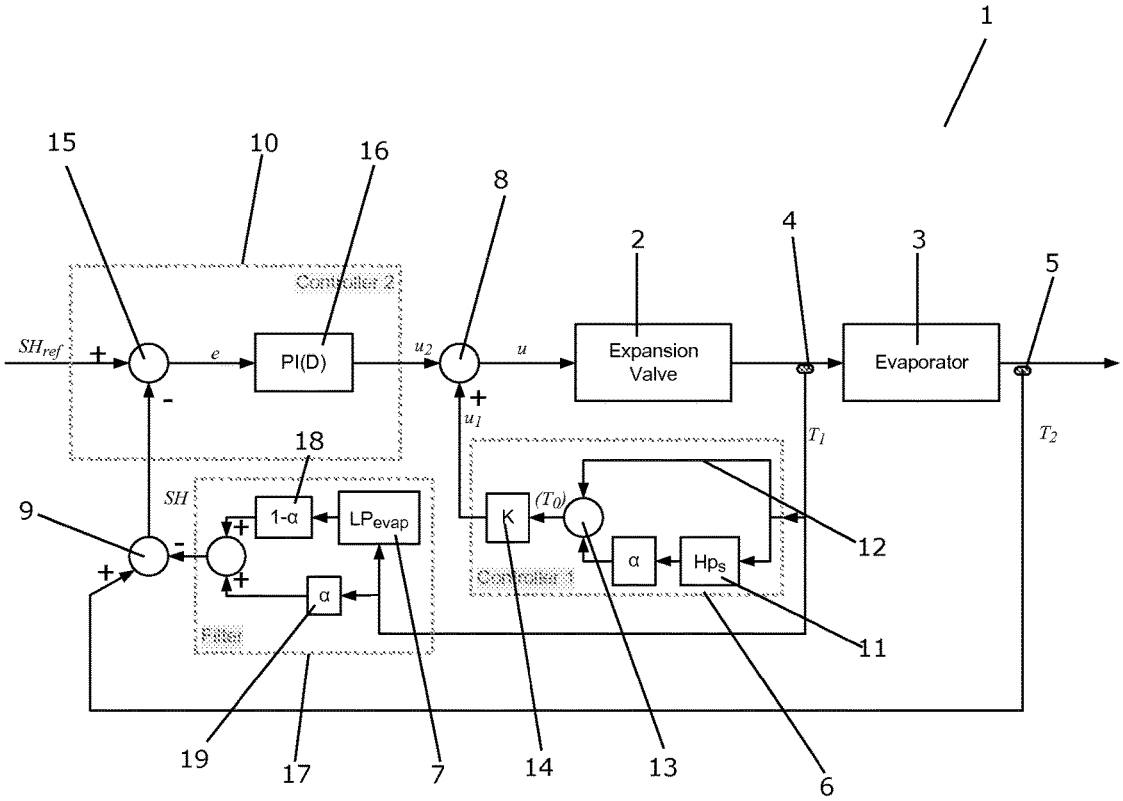
FIG. 3 is a block diagram of a control arrangement according to a third embodiment of the invention.

FIG. 3 is a block diagram of a control arrangement 1 according to a third embodiment of the invention. The control arrangement of FIG. 3 is very similar to the control arrangements 1 of FIGS. 1 and 2, and it will therefore not be described in further detail here.

In FIG. 3, details of the filter block 17 are shown. The filter block 17 comprises a low pass filter 7 arranged in series with a first gain unit 18, and in parallel with a second gain unit 19. The signal supplied by the filter block 17 is, thus, $(1-\alpha)LP(T_1)+\alpha T_1$. Accordingly, if $\alpha=1$, the low pass filtered part of the signal is eliminated, and the signal supplied by the filter block 17 is simply $T_1$, i.e. the control arrangement 1 acts as if the filter block 17 was not present. On the other hand, if $\alpha=0$, the proportional part of the signal is eliminated, and the signal supplied by the filter block 17 is $LP(T_1)$, i.e. the filter block 17 acts as a simple low pass filter.

Thus, by selecting an appropriate value of $\alpha$, where $0\leq\alpha\leq1$, it can be controlled to which extent the signal, $T_1$, should be low pass filtered when passing through the filter block 17. This allows the control arrangement 1 to be used with a vapour compression system where the first sensor is a temperature sensor, as well as with a vapour compression system where the first sensor is a pressure sensor, without having to perform modifications to the control arrangement 1, as described above.

What is claimed is:

1. A control arrangement for controlling a superheat of a vapour compression system, the vapour compression system comprising a compressor, a condenser, an expansion device and an evaporator arranged along a refrigerant path, the control arrangement comprising:

a first sensor arranged to measure a first control parameter of refrigerant flowing in the refrigerant path, a second sensor arranged to measure a second control parameter of refrigerant flowing in the refrigerant path, wherein the superheat value of the vapour compression system can be derived by means of the first control parameter and the second control parameter, a low pass filter arranged to receive a signal from the first sensor, said low pass filter being designed in accordance with dynamic behaviour of the evaporator and/or of the first sensor, a first controller arranged to receive the signal from the first sensor, a subtraction element arranged to receive input from the second sensor and from the low pass filter, said subtraction element being arranged to derive a superheat value, based on the received input, a second controller arranged to receive the superheat value derived by the subtraction element and to supply a control signal, based on the derived superheat value, and in accordance with a reference superheat value, a summation element arranged to receive input from the first controller and from the second controller, said summation element being arranged to supply a control signal for controlling opening degree of the expansion device on the basis of the received input, wherein the low pass filter and the first controller are arranged to receive the signal from the first sensor in parallel signal paths.

2. The control arrangement according to claim 1, wherein the first controller comprises a proportional differential (PD) element having a proportional part and a differential part, and wherein the proportional part and the differential part of the proportional differential (PD) element are positioned in between, in a signal path context, the first sensor and the summation element.

3. The control arrangement according to claim 1, wherein the first controller comprises a high pass filter.

4. The control arrangement according to claim 3, wherein the high pass filter is arranged in parallel to an additional signal path.

5. The control arrangement according to claim 2, wherein the first controller further comprises a proportional gain unit.

6. The control arrangement according to claim 1, wherein the first control parameter is the temperature of refrigerant entering the evaporator.

7. The control arrangement according to claim 1, wherein the first control parameter is the pressure of refrigerant leaving the evaporator.

8. The control arrangement according to claim 1, wherein the second control parameter is the temperature of refrigerant leaving the evaporator.

9. A control arrangement for controlling a superheat of a vapour compression system, the vapour compression system comprising a compressor, a condenser, an expansion device and an evaporator arranged along a refrigerant path, the control arrangement comprising:

a first sensor arranged to measure a first control parameter of refrigerant flowing in the refrigerant path, a second sensor arranged to measure a second control parameter of refrigerant flowing in the refrigerant path, wherein the superheat value of the vapour compression system can be derived by means of the first control parameter and the second control parameter, a first controller arranged to receive a signal from the first sensor, said first controller comprising a proportional differential (PD) element having a proportional part and a differential part, a subtraction element arranged to receive input from the second sensor and from the first sensor, said subtraction element being arranged to derive a superheat value, based on the received input, a second controller arranged to receive the superheat value derived by the subtraction element, and to supply a control signal based on the derived superheat value and in accordance with a reference superheat value, a summation element arranged to receive input from the first controller and from the second controller, said summation element being arranged to supply a control signal for controlling opening degree of the expansion device on the basis of the received input, wherein the proportional part and the differential part of the proportional differential (PD) element are positioned, in a signal path context, after the first sensor and before the summation element.

10. The control arrangement according to claim 9, further comprising a low pass filter arranged to receive the signal from the first sensor and to supply a signal to the subtraction element, said low pass filter being designed in accordance with dynamic behaviour of the evaporator and/or of the first sensor.

11. The control arrangement according to claim 9, wherein the first control parameter is the temperature of refrigerant entering the evaporator.

12. The control arrangement according to claim 9, wherein the first control parameter is the pressure of refrigerant leaving the evaporator.

13. The control arrangement according to claim 9, wherein the second control parameter is the temperature of refrigerant leaving the evaporator.

14. The control arrangement according to claim 2, wherein the first controller comprises a high pass filter.

15. The control arrangement according to claim 3, wherein the first controller further comprises a proportional gain unit.

16. The control arrangement according to claim 4, wherein the first controller further comprises a proportional gain unit.

17. The control arrangement according to claim 2, wherein the first control parameter is the temperature of refrigerant entering the evaporator.

18. The control arrangement according to claim 3, wherein the first control parameter is the temperature of refrigerant entering the evaporator.

19. The control arrangement according to claim 4, wherein the first control parameter is the temperature of refrigerant entering the evaporator.

20. The control arrangement according to claim 5, wherein the first control parameter is the temperature of refrigerant entering the evaporator.

* * * * *